US008161744B2

(12) United States Patent
Winsor et al.

(10) Patent No.: US 8,161,744 B2
(45) Date of Patent: Apr. 24, 2012

(54) INTERNAL COMBUSTION ENGINE WITH TURBOCHARGER SURGE DETECTION AND CONTROL

(75) Inventors: Richard E. Winsor, Waterloo, IA (US); Robert J. McMullen, Waterloo, IA (US)

(73) Assignee: Deere & Company, Moline, IL (US)

( * ) Notice: Subject to any disclaimer, the term of this patent is extended or adjusted under 35 U.S.C. 154(b) by 909 days.

(21) Appl. No.: 12/041,763

(22) Filed: Mar. 4, 2008

(65) Prior Publication Data

US 2009/0223218 A1 Sep. 10, 2009

(51) Int. Cl.

| | |
|---|---|
| ***F02B 33/44*** | (2006.01) |
| ***F02D 23/00*** | (2006.01) |
| ***F02M 25/07*** | (2006.01) |
| ***F01D 17/00*** | (2006.01) |
| ***F01D 19/00*** | (2006.01) |
| ***F04D 15/00*** | (2006.01) |
| ***F04D 27/00*** | (2006.01) |

(52) U.S. Cl. ..... 60/605.1; 60/602; 60/605.2; 415/17

(58) Field of Classification Search ..... 123/559.1–565; 60/597–612, 605.1, 605.2, 600–603; 324/174, 324/207.23, 207.25, 207.15; 415/17; 73/114.77, 73/861.27, 587; 701/100–104, 114, 119
See application file for complete search history.

(56) References Cited

U.S. PATENT DOCUMENTS

| | | | | |
|---|---|---|---|---|
| 3,245,219 | A * | 4/1966 | Warden et al. | 415/17 |
| 4,309,871 | A | 1/1982 | Venema | 60/39.28 R |
| 4,817,387 | A | 4/1989 | Lashbrook | |
| 5,045,765 | A * | 9/1991 | Wissler | 318/382 |
| 5,635,646 | A | 6/1997 | Eriksson | |
| 5,819,538 | A | 10/1998 | Lawson, Jr. | |
| 5,947,680 | A * | 9/1999 | Harada et al. | 415/17 |
| 7,071,841 | B2 * | 7/2006 | Haynes et al. | 701/119 |
| 7,089,738 | B1 | 8/2006 | Boewe et al. | |
| 7,487,639 | B2 * | 2/2009 | Hofstetter | 60/611 |
| 7,762,068 | B2 * | 7/2010 | Tabata et al. | 701/104 |
| 2005/0155349 | A1 * | 7/2005 | Sugiura et al. | 60/605.1 |
| 2005/0257520 | A1 * | 11/2005 | Fischle et al. | 60/600 |
| 2006/0064231 | A1 * | 3/2006 | Fekete et al. | 701/114 |
| 2008/0134789 | A1 * | 6/2008 | Schneider et al. | 73/587 |
| 2009/0193896 | A1 * | 8/2009 | Rose et al. | 73/584 |
| 2009/0290731 | A1 * | 11/2009 | Bierl et al. | 73/861.27 |
| 2010/0000309 | A1 * | 1/2010 | Bierl et al. | 73/114.77 |
| 2011/0079015 | A1 * | 4/2011 | Geis et al. | 701/100 |
| 2011/0093182 | A1 * | 4/2011 | Weber et al. | 701/102 |

FOREIGN PATENT DOCUMENTS

| | | | |
|---|---|---|---|
| DE | 3605958 | A1 | 9/1987 |
| DE | 102005032924 | A1 | 1/2007 |
| GB | 2148509 | A * | 5/1985 |
| JP | 2007092683 | A | 4/2007 |

* cited by examiner

*Primary Examiner* — Thai Ba Trieu
(74) *Attorney, Agent, or Firm* — Taylor IP, P.C.

(57) ABSTRACT

An internal combustion engine includes a block defining a plurality of combustion cylinders, an intake manifold fluidly coupled with at least one combustion cylinder, and an exhaust manifold fluidly coupled with at least one combustion cylinder. An EGR valve may be fluidly coupled between the exhaust manifold and the intake manifold. A turbocharger includes a turbine fluidly coupled with the exhaust manifold, and a compressor fluidly coupled with the intake manifold. A microphone is positioned at the compressor inlet or the compressor outlet provides an output signal. An ECU is coupled with the microphone, and controls operation of an actuatable element of a VGT, an EGR valve, and/or an injected fuel quantity, to prevent surge of the compressor, dependent upon the output signal from the microphone.

17 Claims, 2 Drawing Sheets

INTERNAL COMBUSTION ENGINE WITH TURBOCHARGER SURGE DETECTION AND CONTROL

FIELD OF THE INVENTION

The present invention relates to internal combustion engines, and, more particularly, to turbochargers and turbocharger systems used with such engines.

BACKGROUND OF THE INVENTION

An internal combustion (IC) engine may include one or more turbochargers for compressing a fluid which is supplied to one or more combustion chambers within corresponding combustion cylinders. Each turbocharger typically includes a turbine driven by exhaust gases of the engine and a compressor which is driven by the turbine. The compressor receives the fluid to be compressed and supplies the fluid to the combustion chambers. The fluid which is compressed by the compressor may be in the form of combustion air or a fuel and air mixture.

The operating behavior of a compressor within a turbocharger may be graphically illustrated by a "compressor map" associated with the turbocharger in which the pressure ratio (compression outlet pressure divided by the inlet pressure) is plotted on the vertical axis and the flow rate is plotted on the horizontal axis. In general, the operating behavior of a compressor is limited on the left side of the compressor map by a "surge line" and on the right side of the compressor map by a "choke line". The surge line basically represents "stalling" of the air flow at the compressor inlet. With too small a volume flow and too high a pressure ratio, the flow will separate from the suction side of the blades on the compressor wheel, with the result that the discharge process is interrupted. The air flow through the compressor is reversed until a stable pressure ratio by positive volumetric flow rate is established, the pressure builds up again and the cycle repeats. This flow instability continues at a substantially fixed frequency and the resulting behavior is known as "surging". The choke line represents the maximum centrifugal compressor volumetric flow rate, which is limited for instance by the cross-section at the compressor inlet. When the flow rate at the compressor inlet or other location reaches sonic velocity, no further flow rate increase is possible and choking results. Both surge and choking of a turbocharger compressor should be avoided.

An IC engine also may include an exhaust gas recirculation (EGR) system for controlling the generation of undesirable pollutant gases and particulate matter in the operation of IC engines. EGR systems primarily recirculate the exhaust gas by-products into the intake air supply of the IC engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides (NOx). Furthermore, the exhaust gases typically contain unburned hydrocarbons which are burned on reintroduction into the engine cylinder, which further reduces the emission of exhaust gas by-products which would be emitted as undesirable pollutants from the IC engine.

An EGR system typically recirculates some of the exhaust gases from the exhaust manifold, through an EGR valve, and to the intake manifold. When the exhaust manifold pressure is higher than the intake manifold pressure and the EGR valve is open, some of the intake gases to the intake manifold are drawn from the exhaust manifold, which in turn reduces the volumetric flow rate from the turbocharger compressor. Thus, the problem of compressor surge is compounded with the use of EGR.

What is needed in the art is a method of detecting compressor surge in a turbocharger, and controlling operation of the IC engine to avoid or eliminate compressor surge.

SUMMARY OF THE INVENTION

The invention in one form is directed to an internal combustion engine, including a block defining a plurality of combustion cylinders, an intake manifold fluidly coupled with at least one combustion cylinder, and an exhaust manifold fluidly coupled with at least one combustion cylinder. A turbocharger includes a turbine fluidly coupled with the exhaust manifold, and a compressor fluidly coupled with the intake manifold. The compressor includes an inlet and an outlet. A microphone is positioned in association with the compressor inlet or the compressor outlet. The microphone provides an output signal. An engine control unit (ECU) coupled with the microphone controls operation of the turbocharger to prevent surge of the compressor, dependent upon the output signal from the microphone.

The invention in another form is directed to an internal combustion engine including a block defining a plurality of combustion cylinders, an intake manifold fluidly coupled with at least one combustion cylinder, and an exhaust manifold fluidly coupled with at least one combustion cylinder. A turbocharger includes a variable geometry turbine (VGT) which is fluidly coupled with the exhaust manifold, and a compressor which is fluidly coupled with the intake manifold. The compressor includes an inlet and an outlet. A microphone positioned in association with the compressor inlet or the compressor outlet provides an output signal. An ECU coupled with the microphone controls operation of the VGT to prevent surge of the compressor, dependent upon the output signal from the microphone.

DETAILED DESCRIPTION OF THE INVENTION

Figure 1:
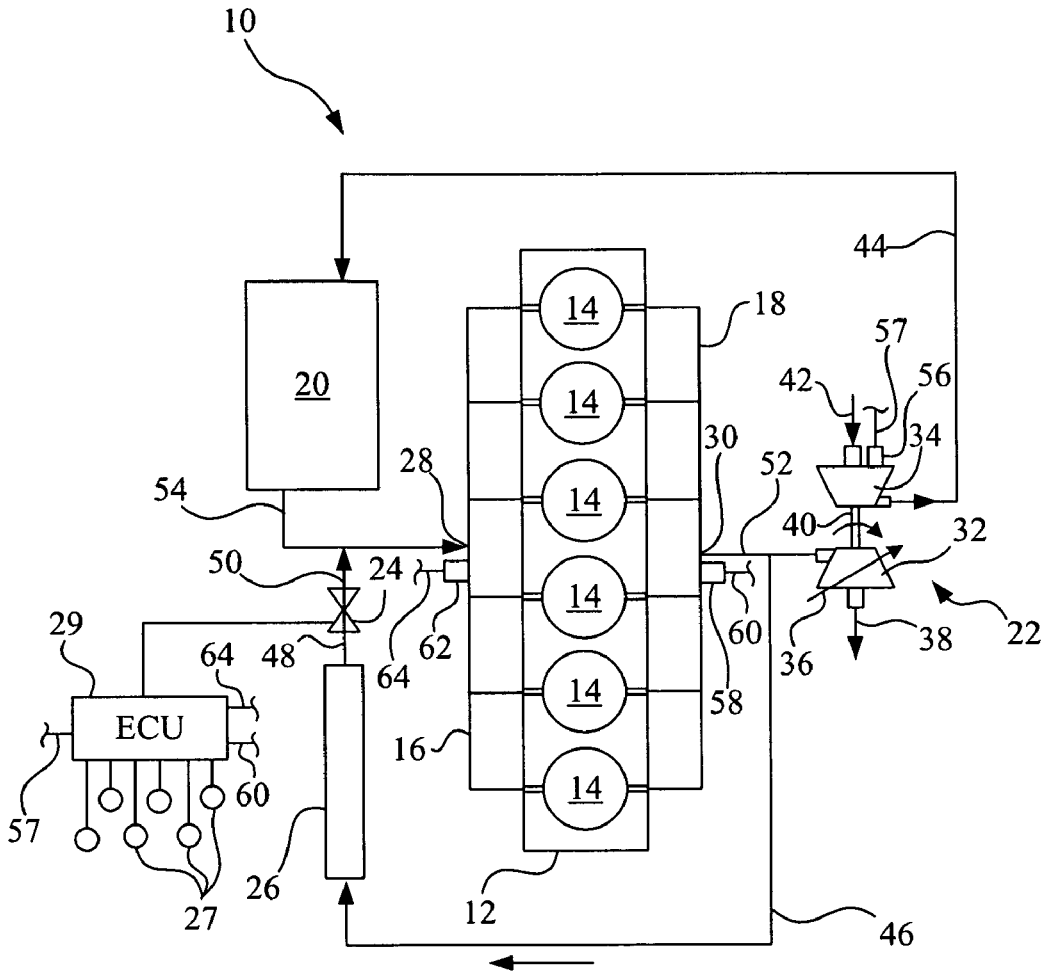
FIG. 1 is a schematic illustration of an embodiment of an IC engine of the present invention.

Referring now to the drawings, and more particularly to FIG. 1, there is shown an embodiment of an IC engine 10 of the present invention, which generally includes a block 12 having a plurality of combustion cylinders 14, intake manifold 16, exhaust manifold 18, charge air cooler 20, turbocharger 22, EGR valve 24 and EGR cooler 26. In the embodiment shown, IC engine 10 is a diesel engine which is incorporated into a work machine, such as an agricultural tractor or combine, but may be differently configured, depending upon the application.

Block 12 is typically a cast metal block which is formed to define combustion cylinders 14. In the embodiment shown, block 12 includes six combustion cylinders 14, but may include a different number depending upon the application. Intake manifold 16 and exhaust manifold 18 are also typically formed from cast metal, and are coupled with block 12 in conventional manner, such as by using bolts and gaskets. Intake manifold 16 and exhaust manifold 18 are each in fluid communication with combustion cylinders 14. Intake manifold 16 receives charge air from charge air cooler 20 at intake manifold inlet 28, and supplies charge air (which may be air or a fuel/air mixture) to combustion cylinders 14. Combustion cylinders 14 also receive fuel from fuel injectors 27 under control of ECU 29. Fuel injectors 27 are typically positioned at the head end of a corresponding combustion cylinder 14, but are simply shown in an array to the side of the engine in FIG. 1 for simplicity sake.

Similarly, exhaust manifold 18 is in fluid communication with combustion cylinders 14, and includes an outlet 30 from which exhaust gas from combustion cylinders 14 is discharged to turbocharger 22.

Turbocharger 22 includes a variable geometry turbine (VGT) 32 and a compressor 34. VGT 32 is adjustably controllable as indicated by line 36, and includes an actuatable element which is controlled electronically using ECU 29. For example, VGT 32 may be actuated by changing the position of turbine blades, a variable size orifice, or other actuatable elements. The turbine within VGT 32 is driven by exhaust gas from exhaust manifold 18, and is exhausted through an outlet to the environment, as indicated by arrow 38.

VGT 32 mechanically drives compressor 34 through a rotatable shaft 40. Compressor 34 is a fixed geometry compressor in the embodiment shown. Compressor 34 receives combustion air from the ambient environment at an inlet, as indicated by line 42, and discharges the compressed combustion air via line 44 to charge air cooler 20. As a result of the mechanical work through the compression of the combustion air, the heated charge air is cooled in charge air cooler 20 prior to being introduced at inlet 28 of intake manifold 16.

EGR valve 24 and EGR cooler 26 are part of an EGR system which also includes a first fluid line 46, second fluid line 48 and third fluid line 50. The term fluid line, as used herein, is intended broadly to cover a conduit for transporting a gas such as exhaust gas and/or combustion air, as will be understood hereinafter.

EGR valve 24 is coupled with and under control of ECU 29. First fluid line 46 is coupled at one end thereof with a fluid line 52 interconnecting exhaust manifold outlet 30 with VGT 32. First fluid line 46 is coupled at an opposite end thereof with EGR cooler 26. Second fluid line 48 fluidly interconnects EGR cooler 26 with EGR valve 24. Third fluid line 50 fluidly interconnects EGR valve 24 with fluid line 54 extending between charge air cooler 20 and inlet 28 of intake manifold 16.

According to an aspect of the present invention, a microphone 56 is positioned in association with an inlet to or outlet from compressor 34 for the purpose of detecting impending or actual surge within compressor 34. Microphone 56 is coupled with ECU 29 via line 57, but could be wirelessly coupled with ECU 29. Microphone 56 provides output signals to ECU 29 corresponding to the flow of combustion air through compressor 34. The value of each output signal represents a sound of the flowing air, which can be a composite signal or separated into amplitude and/or frequency components. Depending upon the specific configuration of compressor 34, the value of the amplitude and/or frequency components of the audio signal can vary during impending or actual surge of the compressor. Nonetheless, the value(s) of the amplitude and/or frequency components can be easily determined empirically for a specific compressor.

A pressure sensor 58 is positioned in association with exhaust manifold 18 to sense a fluid pressure within exhaust manifold 18. Pressure sensor 58 is coupled via line 60 with ECU 29. Similarly, pressure sensor 62 is positioned in association with intake manifold 16 to sense a fluid pressure within intake manifold 16. Pressure sensor 62 is coupled via line 64 with ECU 29.

During operation, IC engine 10 is operated to recirculate a selective amount of exhaust gas from exhaust manifold 18 to intake manifold 16 using an EGR system defined by first fluid line 46, EGR cooler 26, second fluid line 48, EGR valve 24 and third fluid line 50. EGR cooler 26 may also be positioned on the downstream side of EGR valve 24. ECU 29 selectively actuates EGR valve 24 to provide EGR flow of the exhaust gas in the EGR flow direction indicated by the large directional arrow on first fluid line 46. ECU 29 also receives output signals from microphone 56 corresponding to audio signals associated with the flow of combustion air through compressor 34. Upon detection of impending or actual surge, ECU 29 controls operation of compressor 34 either directly through control of VGT 32, or indirectly through control of EGR valve 24 or fuel injectors 27, to avoid or eliminate surge within compressor 34.

Figure 2:
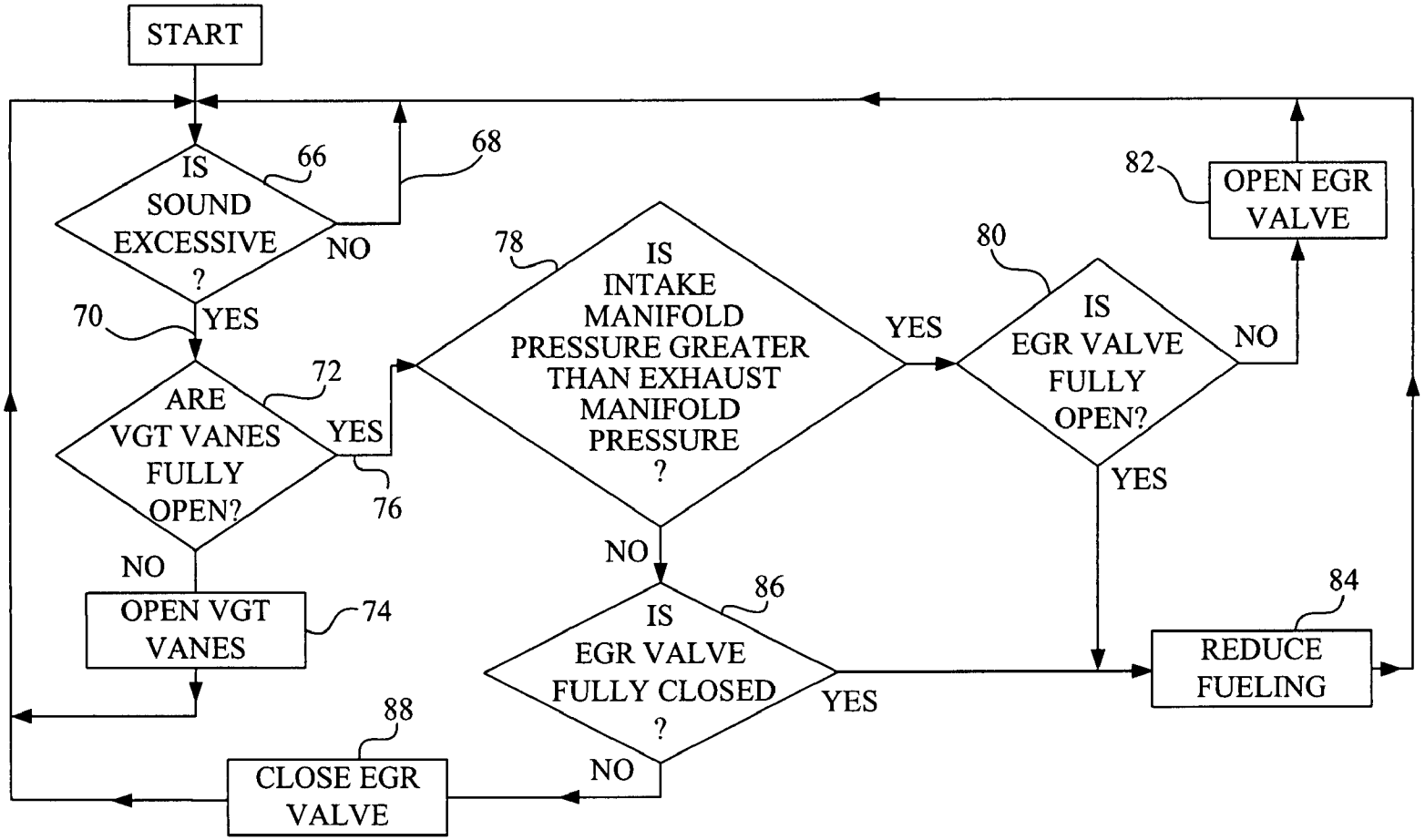
FIG. 2 is a flow chart of an embodiment of the control logic for operation of the IC engine shown in FIG. 1.

More particularly, referring now to the logic flowchart of FIG. 2, an output signal from microphone 56 is compared with a stored threshold value (decision block 66). The output signal can be compared as a composite signal, or the frequency and/or amplitude may be separated and compared using known signal processing techniques. Thus, depending upon how the signal is processed, it may be necessary to use more than one threshold value. If the value of the output signal from microphone 56 is not greater than the threshold, then surge is neither impending nor occurring and control loops back during a wait state (line 68).

On the other hand, if the value of the output signal from microphone 56 is greater than the threshold (line 70), then surge is either impending or occurring (depending on how the threshold is set) and a query is made as to whether the actuatable element in the VGT (e.g., adjustable vanes) is in a position for minimum flow (and thus minimum rotational speed of compressor 34) (decision block 72). For a turbocharger with a fixed geometry turbine, the answer from decision block 72 is assumed to be "YES". Assuming the VGT 32 has adjustable vanes, if the vanes are not in an open position, then they are moved to an open position under control of ECU 29 (block 74) and control returns to block 66. This allows the exhaust gases to flow through the VGT without exerting much force against the vanes, which reduces the speed of the VGT and in turn reduces the speed of the compressor.

If the adjustable vanes of the VGT are already in an open position (line 76), then it is not possible to slow down the compressor by adjusting the position of the vanes, and a determination is made as to whether the intake manifold pressure is greater than the exhaust manifold pressure (decision block 78). This determination is made by comparing an output signal from pressure sensor 62 with an output signal from pressure sensor 58. It will be appreciated that pressure sensor 58 need not necessarily be positioned in communication with exhaust manifold 18, but could be positioned in communication with first line 46, EGR cooler 26 or second line 48. Likewise, pressure sensor 62 need not necessarily be positioned in communication with intake manifold 16, but could be positioned in communication with third line 50, line 54, charge air cooler 20, or line 44.

If the intake manifold pressure is greater than the exhaust manifold pressure, then a query is made as to whether EGR valve 24 is in a fully open position (decision block 80). If EGR valve 24 is not in a fully open position, then EGR valve 24 is opened (block 82) and control returns to block 66. This allows pressurized charge air to flow in a reverse direction through the EGR loop and in turn allows a higher flow rate through compressor 34, thereby avoiding or eliminating surge.

If the EGR valve 24 is already in a fully open position, then ECU 29 controls fuel injectors 27 to reduce fueling to combustion cylinders 14 (block 84). This in turn reduces the rotational speed of VGT 32 and compressor 34, and avoids or eliminates surge within compressor 34. Control then returns to the input side of decision block 66 to monitor the output signals from microphone 56.

On the other hand, if the exhaust manifold pressure is greater than the intake manifold pressure, then it is not possible to cause a flow of charge air in the reverse direction through the EGR loop. In this case, a determination is made as to whether the EGR valve 24 is in a fully closed position (decision block 86). If EGR valve 24 is not in a fully closed position, then EGR valve 24 is closed (block 88) and control returns to the input side of decision block 66 to monitor the output signals from microphone 56. If EGR valve 24 is fully closed, and the exhaust manifold pressure is higher than the intake manifold pressure, then ECU 29 controls fuel injectors 27 to reduce fueling to combustion cylinders 14 (block 84) and control returns to the input side of decision block 66.

In the embodiment shown in FIG. 1, first fluid line 46 is fluidly coupled with fluid line 52 extending between exhaust manifold 18 and VGT 32. However, it will also be understood that first fluid line 46 may be fluidly coupled directly with exhaust manifold 18 for certain applications. Similarly, third fluid line 50 is fluidly coupled with fluid line 54 interconnecting charge air cooler 20 and inlet 28 of intake air manifold 16. However, it will also be understood that third fluid line 50 may be coupled directly with intake manifold 16 in certain applications.

Moreover, in the embodiment shown, turbocharger 22 includes a VGT 32. However, turbocharger 22 may also include a fixed geometry turbine, depending upon the application.

Having described the preferred embodiment, it will become apparent that various modifications can be made without departing from the scope of the invention as defined in the accompanying claims.

The invention claimed is:

1. An internal combustion engine, comprising:

a block defining a plurality of combustion cylinders;

an intake manifold fluidly coupled with at least one said combustion cylinder;

an exhaust manifold fluidly coupled with at least one said combustion cylinder;

a turbocharger including a turbine fluidly coupled with said exhaust manifold, and a single stage fixed geometry compressor fluidly coupled with said intake manifold, said single stage fixed geometry compressor including an inlet and an outlet;

a control device for controlling operation of said turbocharger;

a microphone positioned at one of said single stage fixed geometry compressor inlet and said single stage fixed geometry compressor outlet, said microphone providing an output signal; and an engine control unit (ECU) coupled with said microphone, said ECU controlling operation of said turbocharger control device to prevent surge of said single stage fixed geometry compressor, dependent upon said output signal from said microphone exceeding a threshold value and wherein said value of said output signal corresponds to an amplitude and a frequency of said output signal.

2. The internal combustion engine of claim 1, wherein said turbocharger control device is an exhaust gas recirculation (EGR) valve fluidly coupled between said exhaust manifold and said intake manifold, said ECU controlling operation of said EGR valve to prevent surge of said single stage fixed geometry compressor.

3. The internal combustion engine of claim 2, wherein said ECU closes said EGR valve when the value of said output signal from said microphone is greater than said threshold value.

4. The internal combustion engine of claim 1 wherein said turbocharger control device is a plurality of fuel injectors, each said fuel injector associated with a respective said combustion cylinder, said ECU controlling operation of said plurality of fuel injectors to prevent surge of said single stage fixed geometry compressor.

5. The internal combustion engine of claim 4, wherein said ECU reduces fuel flow from at least one of said fuel injectors to prevent surge of said single stage fixed geometry compressor, when the value of said output signal from said microphone is greater than said threshold value.

6. The internal combustion engine of claim 1, wherein said turbocharger control device is a variable geometry turbine (VGT), and said ECU controls operation of said VGT to prevent surge of said compressor.

7. The internal combustion engine of claim 6, wherein said VGT includes at least one actuatable element, and said ECU controls each said actuatable to prevent surge of said single stage fixed geometry compressor.

8. The internal combustion engine of claim 7, wherein said at least one actuatable element is a plurality of adjustable vanes, and said ECU controls a position of said vanes to prevent surge of said single stage fixed geometry compressor.

9. The internal combustion engine of claim 8, wherein said ECU moves said vanes to an open position to prevent surge of said single stage fixed geometry compressor.

10. An internal combustion engine, comprising:

a block defining a plurality of combustion cylinders;

an intake manifold fluidly coupled with at least one said combustion cylinder;

an exhaust manifold fluidly coupled with at least one said combustion cylinder;

a turbocharger including a variable geometry turbine (VGT) fluidly coupled with said exhaust manifold, and a single stage fixed geometry compressor fluidly coupled with said intake manifold, said single stage fixed geometry compressor including an inlet and an outlet;

a microphone positioned at one of said single stage fixed geometry compressor inlet and said single stage fixed geometry compressor outlet, said microphone providing an output signal; and an engine control unit (ECU) coupled with said microphone, said ECU controlling operation of said VGT to prevent surge of said single stage fixed geometry compressor, dependent upon said output signal from said microphone exceeding a threshold value and wherein said value of said output signal corresponds to an amplitude and a frequency of said output signal.

11. The internal combustion engine of claim 10, wherein said VGT includes at least one actuatable element, and said ECU controls each said actuatable element to prevent surge of said single stage fixed geometry compressor.

12. The internal combustion engine of claim 11, wherein said at least one actuatable element is a plurality of adjustable vanes, and said ECU controls a position of said vanes to prevent surge of said single stage fixed geometry compressor.

13. The internal combustion engine of claim 12, wherein said ECU moves said vanes to an open position to prevent surge of said single stage fixed geometry compressor.

14. The internal combustion engine of claim 10, including an exhaust gas recirculation (EGR) valve fluidly coupled between said exhaust manifold and said intake manifold.

15. The internal combustion engine of claim 14, wherein said ECU closes said EGR valve when the value of said output signal from said microphone is greater than said threshold value.

16. The internal combustion engine of claim 10, including a plurality of fuel injectors, each said fuel injector associated with a respective said combustion cylinder, said ECU controlling operation of said plurality of fuel injectors to prevent surge of said single stage fixed geometry compressor.

17. The internal combustion engine of claim 10, wherein said ECU reduces fuel flow from at least one of said fuel injectors to prevent surge of said single stage fixed geometry compressor, when the value of said output signal from said microphone is greater than said threshold value.

* * * * *